United States Patent [19]

Miller

[11] 4,193,751

[45] Mar. 18, 1980

[54] MULTIPLE DISTRIBUTOR HEADS FOR LAYING DRY FIBERS

[75] Inventor: Fredric N. Miller, Menasha, Wis.

[73] Assignee: American Can Company, Greenwich, Conn.

[21] Appl. No.: 915,865

[22] Filed: Jun. 15, 1978

[51] Int. Cl.[2] ..... B29J 5/00

[52] U.S. Cl. ..... 425/83.1

[58] Field of Search ..... 425/83.1

[56] References Cited

U.S. PATENT DOCUMENTS

| | | | |
|---|---|---|---|
| 3,598,680 | 8/1971 | Lee | 425/82.1 |
| 4,014,635 | 3/1977 | Kroyer | 425/83 |

*Primary Examiner*—Donald E. Czaja
*Assistant Examiner*—James R. Hall
*Attorney, Agent, or Firm*—Robert P. Auber; Ira A. Dorman; George P. Ziehmer

[57] ABSTRACT

Multiple distributor heads of the Kroyer type in side-by-side position over a common suction tunnel for laying fibrous material onto a foraminous forming-wire screen travelling along the tunnel.

3 Claims, 2 Drawing Figures

MULTIPLE DISTRIBUTOR HEADS FOR LAYING DRY FIBERS

BACKGROUND OF THE INVENTION

The original Kroyer process and Kroyer machine are disclosed in the U.S. Pat. Nos. 3,581,706 and 4,014,635 to Karl Kristian Kobs Kroyer. In those prior art patents, fiber is passed through a static wire screen by using downward air flows and rotating paddles or impellers in an enclosed distributor or distributor head. After the fiber has passed through the static wire screen, it is formed on a moving forming-wire screen. The fiber is directed to the moving forming-wire screen by producing a suction under the forming-wire screen and particularly directly beneath the distributor. The front end of the distributor is the end which receives the moving forming-wire screen and the back end of the distributor is the end which delivers the moving forming-wire screen with fibers forming a web thereon. The forming area is closed off by sealing rolls on the front and back ends of the distributor and by side seal deckles.

As the forming-wire screen speed of a Kroyer machine increases, the sealing rolls build up electrostatic charges causing the fibers to stick to the rolls which disrupts the already-formed web. The sealing rolls perform well at screen speeds up to about 200 feet per minute, but their performance degrades as the speed increases so that by the time the moving forming-wire screen is moving between 500 and 700 feet per minute the formed web is totally disrupted by the sealing rolls.

Gaps between the sealing rolls and the side deckles also allow air to pass into the forming area from the outside atmosphere, disrupting the web edges. The disrupted edges then jam the next sealing roll with fiber locking into the gap between the sealing roll and the side seal deckle.

When two or more distributors, each having a pair of sealing rolls, are used, the fiber web or mat lifts off the wire at higher speeds because of windage and the fact that there is no vacuum under the moving forming-wire screen between the exit sealing roll of one distributor and the entrance sealing roll of the next distributor to hold the web down.

In a patent application filed concurrently herewith by Dennis L. Mielke, entitled APPARATUS FOR THE DEPOSITION OF DRY FIBERS ON A FORAMINOUS FORMING SURFACE, there is disclosed and claimed the concept of using a common tunnel for the forming area of two Kroyer type machines with a space between the machines. Perforations are made in the top of the tunnel between the machines to minimize turbulence in that region and in the baffle below the moving forming-wire screen in the region between the Kroyer machines to hold the web on the forming-wire screen. Such a design has run successfully at 1,000 feet per minute with good web formation. However, in the areas between the distributors there occurred some air turbulence which resulted in fiber building on the sides. In unperforated areas of the top of the tunnel, when the build-ups became large enough they fell onto the web producing localized spots of high basis weights and high opacity which were readily noticeable. In addition, such localized spots were proved to pick in the embossing process leading to a poorer running sheet.

Further, the pulling of air through the web to hold it down in the areas between distributors is an energy wasteful process.

The following issued patents in addition to the above-mentioned Kroyer patents, are representative of the state of the art:

Austrian Pat. No. 220,446 to Weyerhauser Timber Co. teaches a plurality of non-Kroyer type distributors for laying fibrous material.

U.S. Pat. No. 3,825,381 to Danning teaches a plurality of non-Kroyer type distributors for forming airlaid wood fiber webs.

U.S. Pat. No. 3,645,457 to Greten, et al teaches two non-Kroyer type distributors depositing wood chips on a belt.

U.S. Pat. No. 3,598,680 to Lee teaches two non-Kroyer type distributors depositing fibers on a belt.

U.S. Pat. No. 3,080,617 to Lytton teaches a plurality of non-Kroyer distributors depositing consecutive layers of fibers on a belt.

U.S. Pat. No. 3,071,822 to Meiler teaches a plurality of non-Kroyer felters delivering fibers to a belt.

U.S. Pat. No. 2,165,280 teaches a plurality of non-Kroyer blowers delivering fibers to a belt.

BRIEF DESCRIPTION OF THE INVENTION

A multi-distributor head is contemplated by this invention wherein Kroyer type distributor heads are positioned side by side with a common tunnel therebeneath in the forming region. All of the sealing rolls are eliminated except those at the entrance and exit of the common tunnel. Further, the sealing roll at the entrance may readily be eliminated, and that entrance end may be closed, leaving a small slot through which the forming-wire screen enters the tunnel. The degree of suction under the forming-wire screen is such that horizontal components of air at the ends of the tunnel are insignificant.

The use of a plurality of smaller distributor heads lays down a more uniform mat or web of fibrous material than one very large machine.

It is therefore an object of this invention to produce a more uniform fibrous web or mat of air laid dry fibrous material on a foraminous forming-wire screen.

It is another object to this invention to produce such a uniform web or mat with a minimum of power or energy use.

It is another object to this invention to minimize fiber build up in regions other than on the moving foraminous wire screen.

BRIEF DESCRIPTION OF THE DRAWINGS

Other objects will become apparent from the following description taken in connection with the accompanying drawings in which.

DETAILED DESCRIPTION OF THE INVENTION

Figure 2:
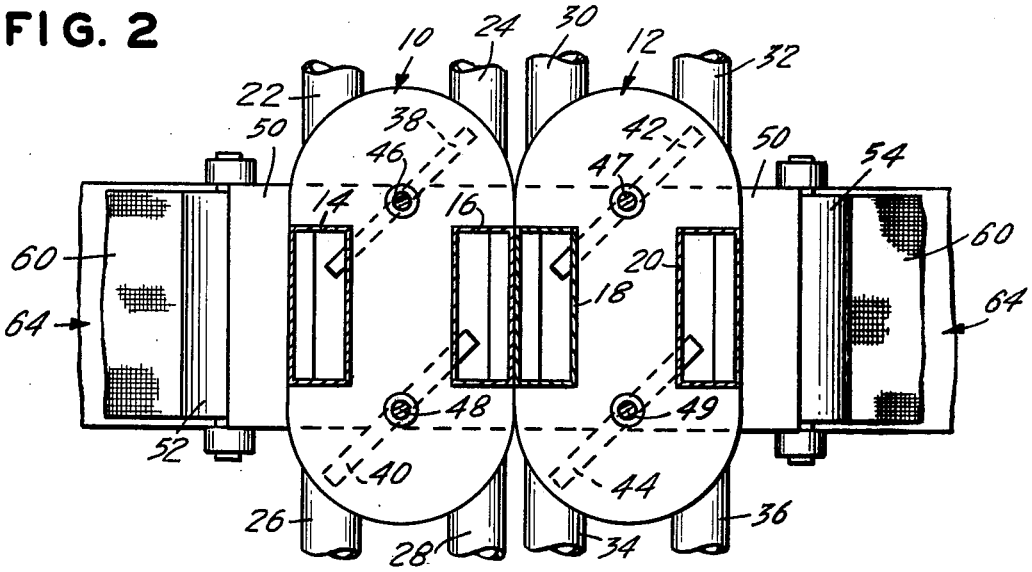
FIG. 2 is a top view of the apparatus of FIG. 1, partly in section, and showing portions of the distributor heads in dashed outline.

The distributor heads include housings 10 and 12 each having inlet conduits 14, 16, 18, 20 for delivering fibrous material thereto. The exit housings are provided with conduits 22, 24, 26, 28, 30, 32, 34 and 36 for retrieving fibrous material which is excessive in size and for returning it to a reservoir or hammermill. Within the housings 10 and 12 are a plurality of impellers 38, 40, 42, and 44 which are rotatably driven on vertical shafts 46, 48, 47 and 49. The motive means is not shown. More than one impeller may be positioned on each of the shafts, and more than two shafts may be used. Typically the impellers turn in the same direction. Only half of the exit conduits 22, 24, 26, 28, 30, 32, 34, 36 are used at any one time, depending upon the direction of rotation of the impellers 38, 40, 42, 44. When the impellers 38 and 40 are turning clockwise (i.e. righthand) from the view point of FIG. 2, exit conduits 22 and 28 are used while exit conduits 24 and 26 are blocked. When the impellers 38 and 40 are turning counter-clockwise, the exit conduits 24 and 26 are used while conduits 22 and 28 are blocked.

Figure 1:
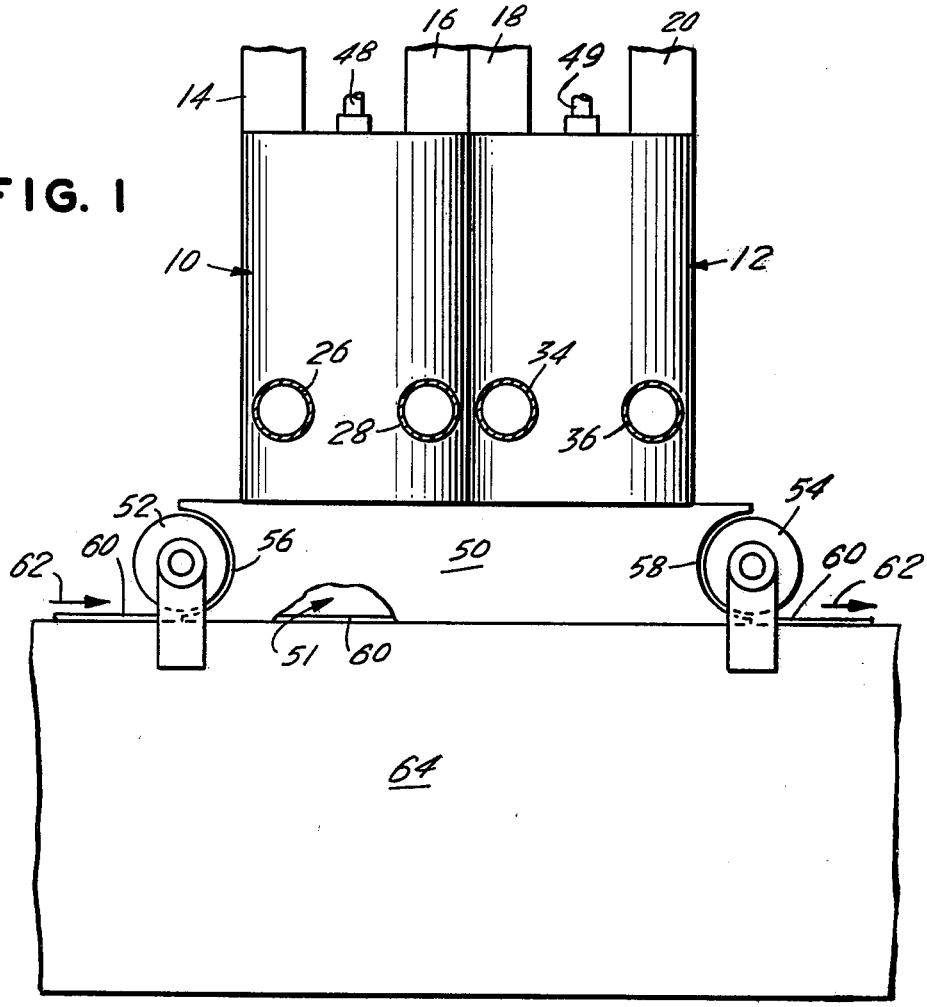
FIG. 1 is a vertical side view of a plurality of distributor heads for delivering air laid dry fibers to a foraminous forming-wire screen in a common tunnel having common side deckles.
Figure 2:
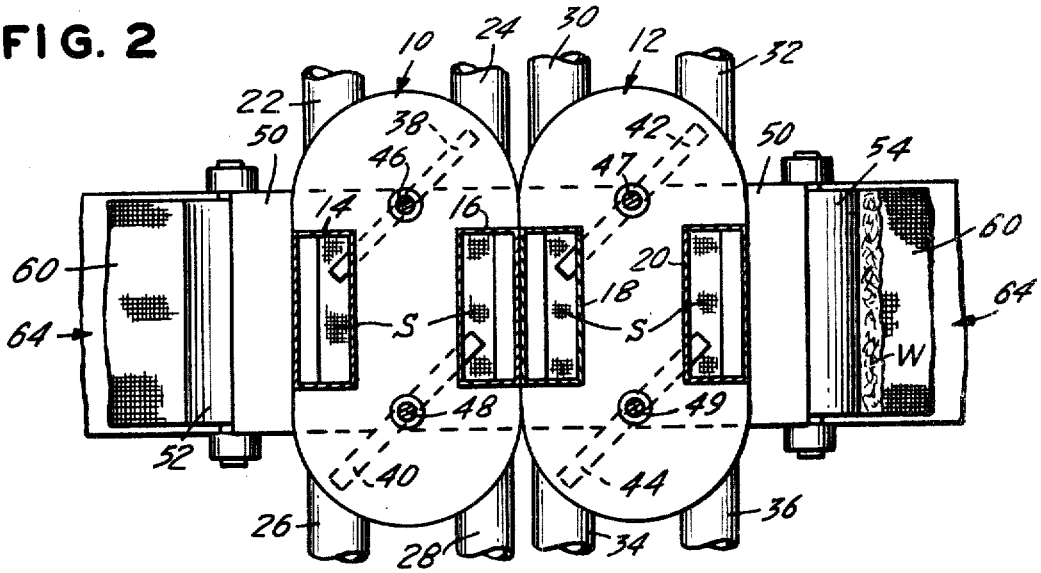
Figure 1:
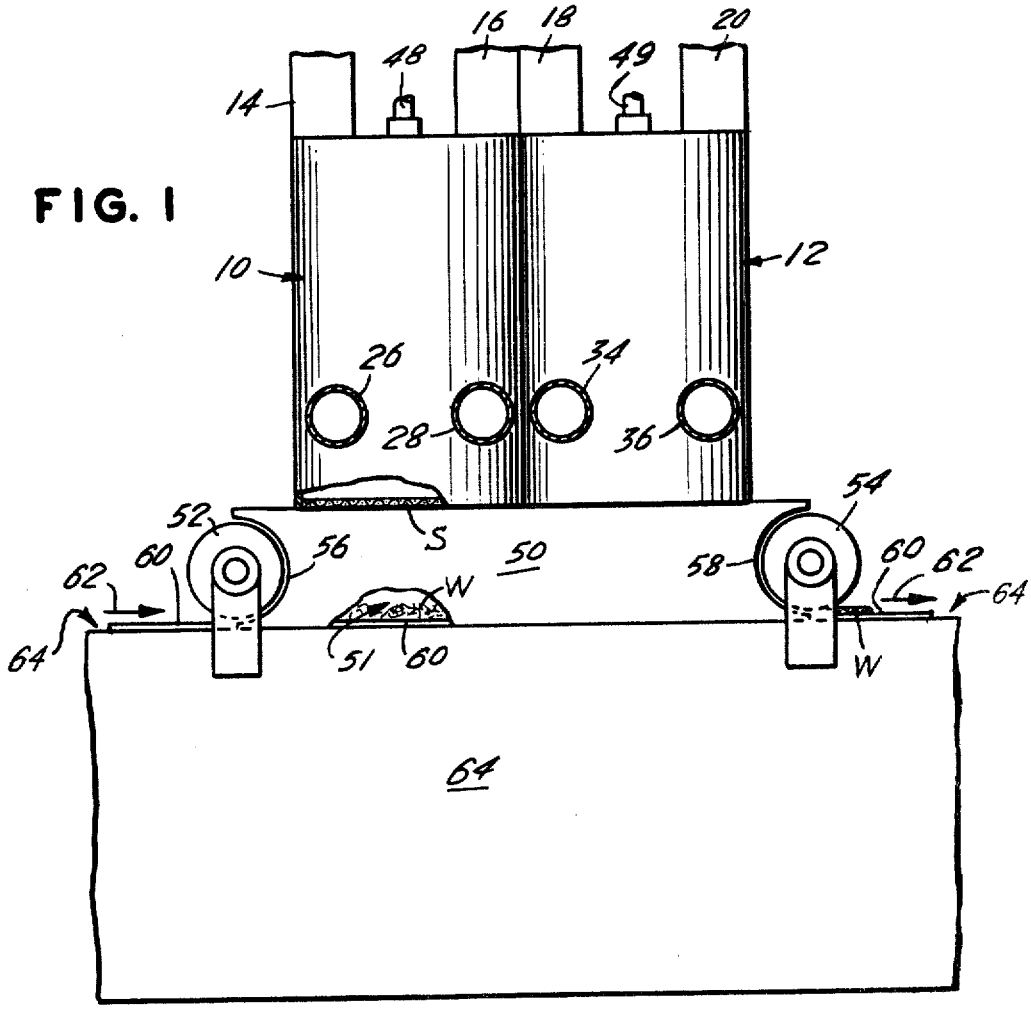

The bottoms of the housing 10 and 12 are open with a foraminous screen S stretched across the opening. Portions of the opening may be blocked, if desired. The openings of the bottoms of housings 10 and 12, and any additional housings which may be placed side-by-side with the two shown housings, open into a common tunnel having common side deckles such as deckle 50. The tunnels are substantially sealed by rotatable sealing rolls 52, 54 at the ends of the tunnels. Only a small gap 56, 58 is allowed between the sealing rolls 52, 54 and the side deckles 50 and an additional deckle on the backside of FIG. 1 but not shown.

A moving foraminous forming-wire screen 60 upon which a mat or web of fibrous material is formed travels from one end to the other of the tunnel sequentially beneath one then another of the openings and beneath the rolls 52, 54.

The roll 54 helps to compress the mat or web W of fibrous material as it leaves the tunnel. The direction of motion of the forming-wire screen 60 and its supported mat or web is shown by the arrows 62.

A suction box 64 maintains a partial vacuum beneath the foraminous forming-wire screen 60 to cause the descending fibers to form the mat or web (not shown) on the moving screen 60 and to hold the web on the screen.

If desired, in accommodation of movement of screen 60 through the tunnel, the roll seal 52 may be eliminated, and that entrance end of the common tunnel 51 may be partially closed, leaving a slot through which the screen 60 may enter the tunnel.

Thus, the apparatus of this invention lays down a mat or web of fibrous material onto a foraminous forming-wire screen with the distributor housings side-by-side, leaving no gap therebetween and delivering their fibers into a common tunnel 51, whereby fluffing of the mat or web within the tunnel 51 is eliminated, and sticking of the fibrous material to the walls and to the roller seals is minimized.

Although the invention has been described in detail above, it is not intended that the invention should be limited by that description but only by the combination of that description together with the accompanying claims.

I claim:

1. Apparatus for disposing a uniform web of dry fibers on a forming-wire screen, comprising: a plurality of fiber distributors including housings disposed in side-by-side relationship with no gap therebetween and having bottom openings disposed in side-by-side relationship; foraminous screens extending over said openings; a forming tunnel disposed beneath said openings; a movable forming-wire screen disposed within said tunnel for travel therethrough sequentially beneath one then another of said openings; means for introducing dry fibers to said housings for discharge through said openings, and the screens extending thereover, onto said forming-wire screen as it is moved therepast; and sealing means on opposite ends of said tunnel accommodating movement of said forming-wire screen therethrough.

2. Apparatus according to claim 1, and further comprising means for maintaining a partial vacuum beneath said movable forming-wire screen to draw fibers discharged from said bottom openings onto said forming-wire screen.

3. Apparatus according to claim 2, and further characterized in that the sealing means on at least the end of the tunnel from which said movable screen leaves comprises a sealing roll disposed to compress a web formed on said screen as it leaves said tunnel.

* * * * *

UNITED STATES PATENT AND TRADEMARK OFFICE

CERTIFICATE OF CORRECTION

PATENT NO. : 4,193,751

DATED : March 18, 1980

INVENTOR(S) : Fredric N. Miller

It is certified that error appears in the above—identified patent and that said Letters Patent is hereby corrected as shown below:

The title page and the sole sheet of drawing should be deleted to appear as per attachments.

Signed and Sealed this

*Fifteenth* Day of *July 1980*

[SEAL]

*Attest:*

SIDNEY A. DIAMOND

*Attesting Officer*

*Commissioner of Patents and Trademarks*

United States Patent [19]

Miller

[11] 4,193,751

[45] Mar. 18, 1980

[54] MULTIPLE DISTRIBUTOR HEADS FOR LAYING DRY FIBERS

[75] Inventor: Fredric N. Miller, Menasha, Wis.

[73] Assignee: American Can Company, Greenwich, Conn.

[21] Appl. No.: 915,865

[22] Filed: Jun. 15, 1978

[51] Int. Cl.[2] ..... B29J 5/00
[52] U.S. Cl. ..... 425/83.1
[58] Field of Search ..... 425/83.1

[56] References Cited

U.S. PATENT DOCUMENTS

| | | | |
|---|---|---|---|
| 3,598,680 | 8/1971 | Lee | 425/82.1 |
| 4,014,635 | 3/1977 | Kroyer | 425/83 |

*Primary Examiner*—Donald E. Czaja
*Assistant Examiner*—James R. Hall
*Attorney, Agent, or Firm*—Robert P. Auber; Ira A. Dorman; George P. Ziehmer

[57] ABSTRACT

Multiple distributor heads of the Kroyer type in side-by-side position over a common suction tunnel for laying fibrous material onto a foraminous forming-wire screen travelling along the tunnel.

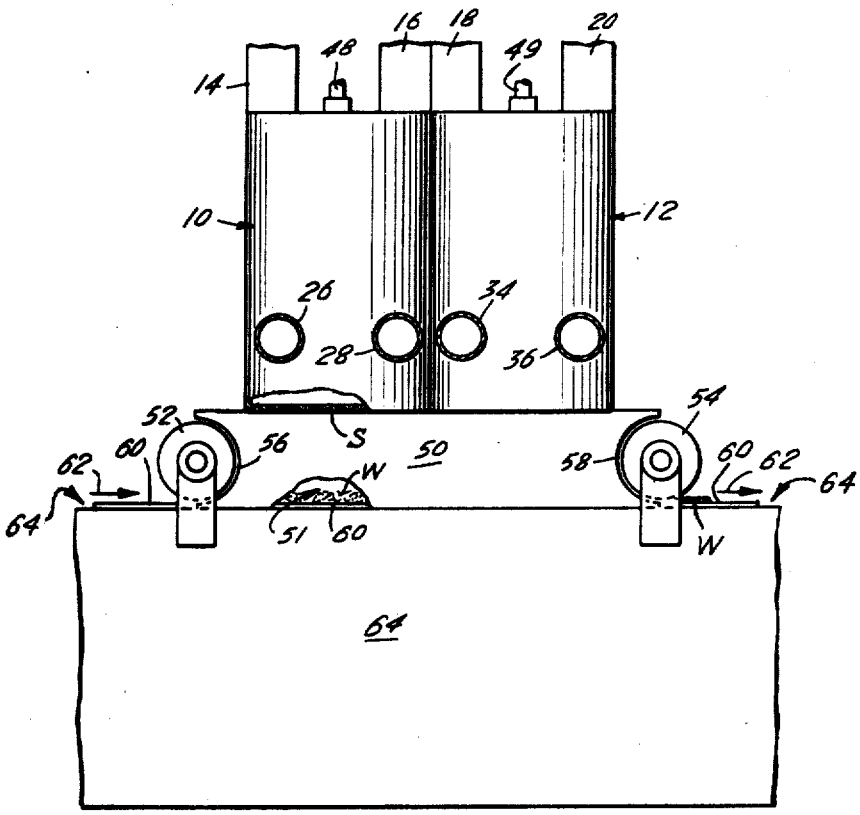

3 Claims, 2 Drawing Figures